US006406014B1

(12) United States Patent
Reist

(10) Patent No.: US 6,406,014 B1
(45) Date of Patent: Jun. 18, 2002

(54) METHOD AND APPARATUS FOR TRANSPORTING OBJECTS ARRIVING IN AN OVERLAPPING FORMATION

(75) Inventor: Walter Reist, Hinwil (CH)

(73) Assignee: Ferag AG, Hinwil (CH)

( * ) Notice: Subject to any disclaimer, the term of this patent is extended or adjusted under 35 U.S.C. 154(b) by 0 days.

(21) Appl. No.: 09/584,595

(22) Filed: May 31, 2000

(30) Foreign Application Priority Data

May 31, 1999 (CH) ..... 1014/99

(51) Int. Cl.[7] ..... B65G 47/26

(52) U.S. Cl. ..... 271/3.24; 271/82; 271/204; 271/277; 271/225; 271/184; 271/101; 271/408; 271/198; 271/803.8

(58) Field of Search ..... 101/408; 198/803.7, 198/803.8; 271/3.24, 277, 204, 82, 225, 184; 399/304

(56) References Cited

U.S. PATENT DOCUMENTS

| | | | | |
|---|---|---|---|---|
| 3,809,214 A | | 5/1974 | Reist | |
| 4,201,377 A | | 5/1980 | Honegger | |
| 4,437,560 A | * | 3/1984 | Wolf | 198/457 X |
| 4,512,457 A | * | 4/1985 | Reist et al. | 198/479 X |
| 4,953,847 A | | 9/1990 | Honegger | |
| 5,295,679 A | | 3/1994 | Reist | |
| 5,716,190 A | * | 2/1998 | Rtahert | 414/794.3 X |

FOREIGN PATENT DOCUMENTS

| | | |
|---|---|---|
| EP | 0 310 988 A2 | 4/1989 |
| EP | 0 484 177 A1 | 5/1992 |
| EP | 0 901 977 A1 | 3/1999 |
| WO | WO 94/13566 A1 | 6/1994 |
| WO | WO 99/55609 A1 | 11/1999 |

* cited by examiner

*Primary Examiner*—David H. Bollinger
*Assistant Examiner*—Kenneth W Bower
(74) *Attorney, Agent, or Firm*—Alston & Bird LLP

(57) ABSTRACT

Flat rectangular objects, such as printed products, arrive in an overlapping formation and have a specific first extent $A_1$ and a variable second extent $A_2$, $A_2'$ running at right angles thereto. The objects 10 are conveyed in an overlapping stream S at a constant predetermined overlap distance B and with a first extent $A_1$ running in the conveying direction F. As viewed in the conveying direction F, the edges running in the conveying direction F are mutually aligned on one side and are at the same location. A specific number of the objects 10 is in each case gripped by a single transport clamp 18 to transport them onward.

5 Claims, 3 Drawing Sheets

METHOD AND APPARATUS FOR TRANSPORTING OBJECTS ARRIVING IN AN OVERLAPPING FORMATION

BACKGROUND OF THE INVENTION

The present invention relates to a method and an apparatus for transporting flat, generally rectangular objects, such as printed products, arriving in an overlapping formation.

A method and an apparatus of this type are disclosed, for example, in WO99/55609. The flat objects, such as printed products, are transported in an overlapping stream resting on a belt conveyor. In this case, the objects can have a different extent, as viewed in the conveying direction, or can be arranged in the overlapping formation with a different overlap distance—that is to say the distance between the leading edges of successive objects. Connected downstream of the belt conveyor is a clamp transporter, which in each case grips one section—that is to say a specific number of objects—by means of a single transport clamp in order to be transported onward. In order that one tongue of the transport clamp can in each case engage between the last object of the preceding section and the first object of the section to be gripped, a possibility of engagement is created in the overlapping stream. This limits the processing speed and requires complicated apparatus.

It is therefore an object of the present invention to provide a method and an apparatus for transporting flat, at least approximately rectangular objects arriving in an overlapping formation which, with a high processing capacity and using simple apparatus, permits the transport of objects which have a specific first extent in one direction and a variable second extent in a direction running at right angles thereto.

SUMMARY OF THE INVENTION

The above and other objects and advantages of the present invention are achieved by the provision of a method and apparatus which includes a conveying conveyor which conveys the objects in an overlapping stream in which the overlap distance is constant, irrespective of the extent of the objects. In addition, the objects in the overlapping stream are arranged with a specific first extent—that is to say always the same extent—running in the conveying direction. Their second extent, at right angles to the conveying direction, can be variable. In other words, in spite of different formats, the objects are conveyed in a regular overlapping stream with a constant overlap distance and constant length of the mutual overlap of two adjacent objects in each case. This permits transport clamps to be arranged at a fixed distance one behind another, irrespective of the format of the objects, in order in each case to grip a specific number of objects—a so-called section—by means of a single transport clamp, each object being held by a single transport clamp in order to be transported onward. At the same time, the transport clamps can grip the objects conveyed in the overlapping stream to transport them onward without the formation of gaps.

In one preferred embodiment, the apparatus further includes an upstream feed conveyor which is configured to convey the objects in an overlapping stream with the first extent running at right angles to its conveying direction. A transfer device is positioned between the feed conveyor and the conveying conveyor for transferring objects from the feed conveyor into the overlapping stream on the conveying conveyor.

BRIEF DESCRIPTION OF THE DRAWINGS

The present invention will now be explained in more detail using exemplary embodiments illustrated in the drawing, in which.

DETAILED DESCRIPTION OF THE PREFERRED EMBODIMENTS

Figure 1:
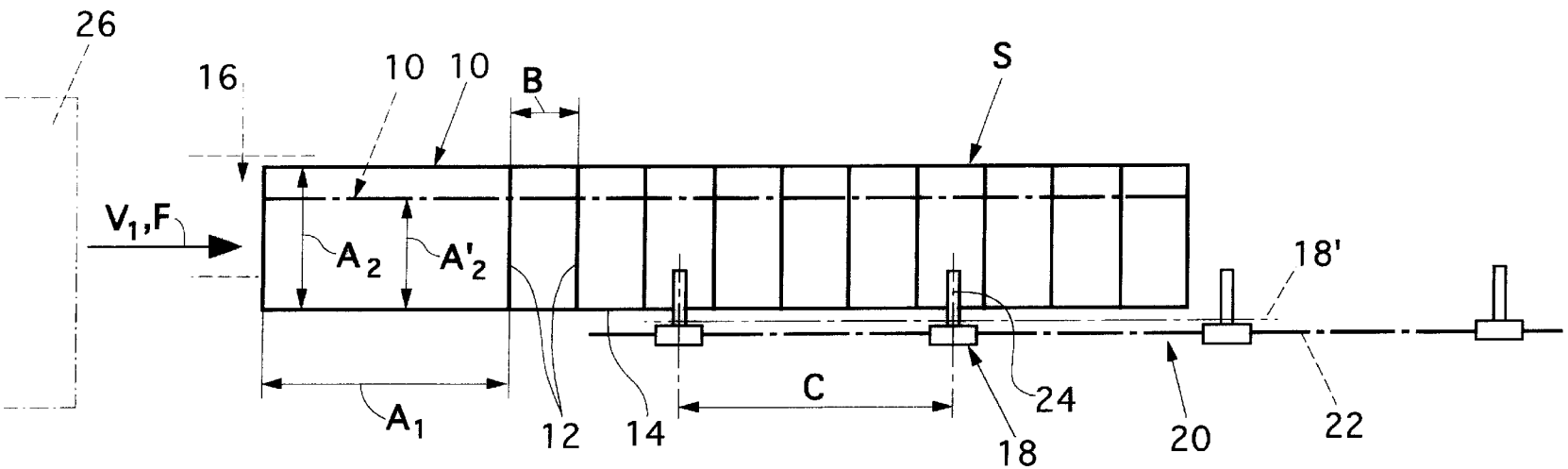
FIG. 1 shows a plan view of an overlapping stream, whose objects can have a different extent at right angles to the conveying direction F and are gripped from one side by means of transport clamps in order to be transported onward.

According to FIG. 1, the flat rectangular objects 10, in the present case printed products such as newspapers, periodicals and the like, are conveyed in the conveying direction F at the conveying speed $v_1$ in an overlapping stream S. The objects always have a specific first extent $A_1$ measured in the conveying direction F; that is to say, as viewed in the conveying direction F, they are always equally long. Their extent at right angles to the conveying direction—that is to say their width—can be different, as is indicated by the second extents $A_2$ and $A_2'$. In addition, the overlap distance B is always constant. The overlap distance is understood to mean the distance between the leading edge 12 of successive objects 10. Since the objects 10, measured in the conveying direction F, always have a specific first extent Al, the distance between the trailing edges of the objects also corresponds to the overlap distance B.

Furthermore, the objects 10 in the overlapping stream S are arranged in such a way that their side edges 14, located on the right in the conveying direction and running in the conveying direction F, are mutually aligned. The right-hand side edge of the overlapping stream is thus always in a specific lateral position, irrespective of the format of the objects 10.

The overlapping stream S is transported on a conveying conveyor which as illustrated comprises a belt conveyor 16 (indicated by dashed lines). The stream projects laterally beyond the belt conveyor 16 with an edge region adjoining the side edge 14.

To the side of the belt conveyor 16—on that side of the overlapping stream S on which the side edges 14 assume the specific position—there runs the movement path 18' of the transport clamps 18 of a conveying device 20. The transport clamps 18 are arranged one behind another at a constant center spacing C on a conveying element 22 that is driven in the conveying direction F at the conveying speed $v_1$. The transport clamps 18 are intended in each case to grip a specific number—a section—of the objects 10 of the overlapping stream S from the side, and to hold them for onward transport. The center spacing C of the transport clamps 18 is selected such that each of the objects 10 is gripped only by a single transport clamp 18—that is to say the transport clamps 18 grip the frontmost object 10 of a section—as viewed in the conveying direction F—adjacent to its rear edge and the rearmost object 10 of this section adjacent to its front edge 12. In other words, the objects 10 are gripped by means of the transport clamps 18, in the event that these are formed by narrow clamping tongues 24, as viewed in the conveying direction F, in a region in which all the objects 10 of one section overlap. Gripping these objects 10 at the side by means of the transport clamps 18 permits the design of the transport clamps 18 with short clamping tongues as viewed in the direction at right angles to the conveying direction F.

The transport clamps 18, with clamping tongues 24 in the open position, are brought up from the side to the side edge 14 of the objects of the overlapping stream S and are then transferred into the closed position. As soon as the transport clamps 18 have been brought into the closed position, the objects 10 can be conveyed away from the belt conveyor 16. For onward transport, they can either be transferred into a hanging attitude or can be conveyed onward supported in a horizontal attitude outside the movement path 18' of the transport clamps 18.

The section by section onward transport of the objects 10 can be carried out in the same conveying device 20, irrespective of the format of the objects 10.

Longitudinally delivering rotary printing machines produce printed products with a constant first extent $A_1$ in the delivery direction, and deliver said products in a regular overlapping formation. The second extent $A_2$, $A_2'$ of the printed products, that is to say their width, can be different, depending on the desired format, for example of the newspaper. The present invention permits products to be removed from such longitudinally delivering rotary printing machines without changing the formation, using an extremely simply designed clamp transporter of the type of a section conveyor, without it being necessary to disrupt the overlapping formation.

In the case of transversely delivering rotary printing machines 26, and in the case of feeding from storage units, such as reels, the flat objects 10, the printed products, as viewed in the delivery direction, can have a different length, that is to say a different second extent $A_2$. On the other hand, in this case the width of the objects 10, that is to say the first extent $A_1$, is always unchanged. From an overlapping formation of this type, by means of deflection or rotation of the objects, an overlapping stream is then formed in which the specific first extent $A_1$ of the objects 10 runs in the conveying direction F, the overlap distance S is constant and one side edge 14 of the objects 10 is mutually aligned and located in a specific lateral position.

Figure 2:
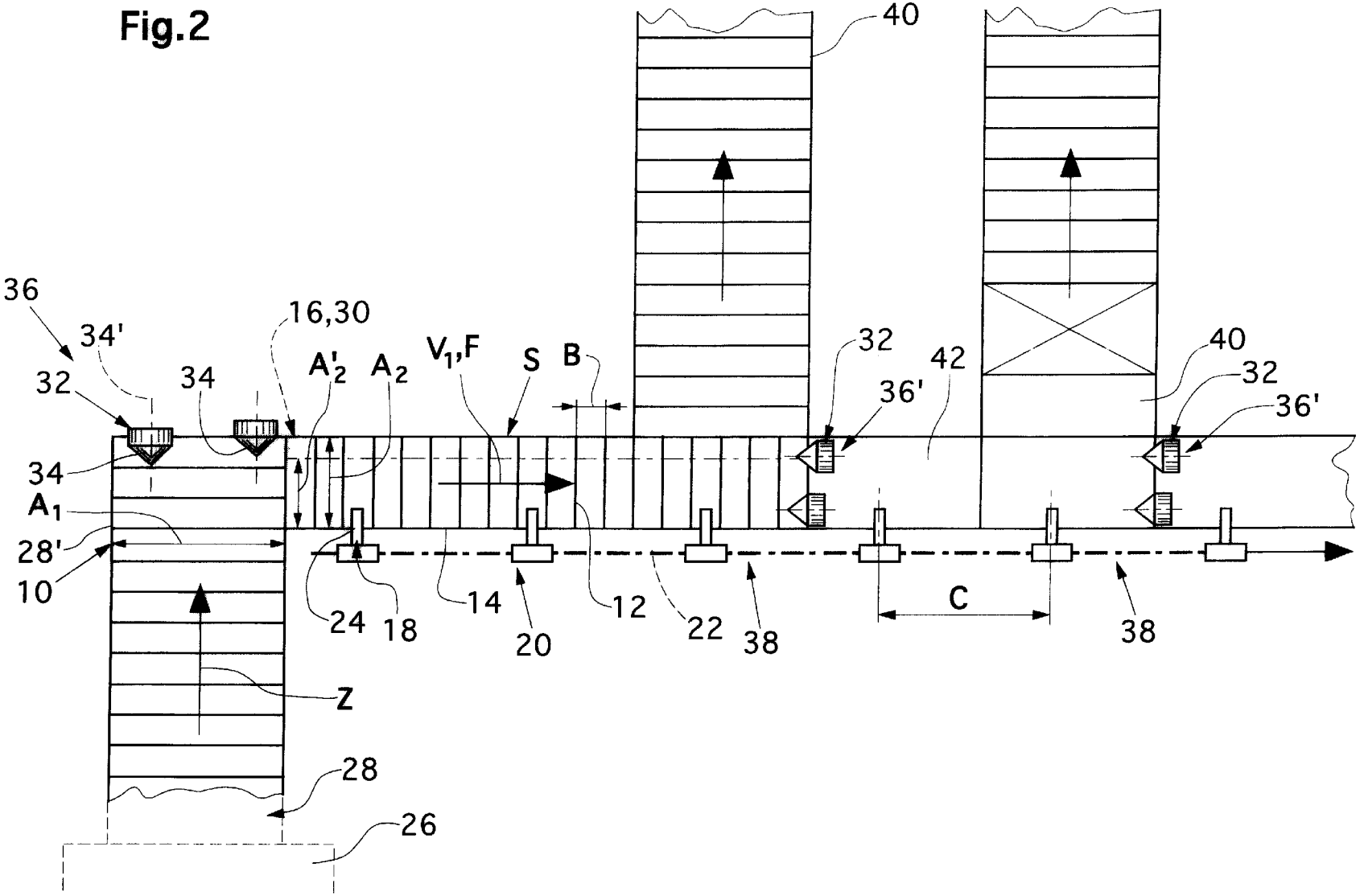
FIG. 2 shows an apparatus for the section by section transport of objects with transport clamps, it being possible for the objects to arrive with a different extent in the conveying direction Z.

FIG. 2 shows a first embodiment, in which by means of deflection of the objects from a transversely delivering rotary printing machine 26 through 90°, an overlapping stream S of this type is formed from the overlapping formation arriving. The outlet 28' of a feed conveyor 28 designed as a belt conveyor—this may also be the delivery belt of the rotary printing machine—is arranged on one side of a discharge conveyor 30, which runs at right angles to the feed direction Z of the feed conveyor 28. Arranged above the discharge conveyor 30, designed as a belt conveyor, and assigned to the latter is a deflection element 32, which is mounted so as to circulate, at a distance from the outlet 28'. Together with the discharge conveyor 30, said deflection element 32 forms a conveying gap which tapers in the direction Z of the feed conveyor and acts in the same direction as the conveying direction F of the discharge conveyor 30. The deflection element 32 has two conical rolls 34, spaced apart from each other as viewed in the conveying direction F, which are driven in rotation about axes 34' and which run in the feed direction Z. A transfer device 36 of this type is disclosed by CH-A-617 408 and in the corresponding U.S. Pat. No. 4,201,377. With regard to the construction and functioning of the transfer device 36, reference is expressly made to these printed documents.

The discharge conveyor 30 corresponds, in its construction and functioning, to the belt conveyor 16 according to FIG. 1. Also provided, as shown and described in FIG. 1, is a conveying device 20, which is intended to grip the objects 10 conveyed in the overlapping stream S by means of the discharge conveyor 30 section by section at the side.

Downstream of the discharge conveyor 30, the conveying device 20 has a number of output points 38—two are shown in FIG. 2. Each output point 38 is assigned a further belt conveyor 40, which has a further transfer device 36' which is of the same construction as the transfer device 36, but, depending on the operating case, it is possible for the deflection elements 32 to be moved from a deflection position into a rest position and back again. In the deflection position, the deflection elements 32 form the effective conveying gap together with a relevant belt conveyor. In the rest position, however, they are removed from the movement path of the objects 10 held by the transport clamps 18, so that said objects can be conveyed past the relevant output point 38 to a further output point.

For completeness, it should be mentioned that the position of the deflection elements 32 of the transfer device 36 is adjustable in the feed direction Z in accordance with the second extent $A_2$, $A_2'$ of the objects 10, in such a way that those side edges 14 of the objects in the overlapping stream S which face the conveying device 20 are always at the same location.

The functioning of the apparatus shown in very simplified form in FIG. 2 is as follows: the rotary printing machine 26 delivers the objects 10 in an overlapping formation, in which the first extent Al of the objects, measured at right angles to the delivery direction, always has the same specific size. The second extent $A_2$, $A_2'$, measured in the delivery direction, can be different, however. If objects 10 with the second dimension $A_2$ are delivered, these are fed to the transfer device 36 in the feed direction Z in the regular overlapping formation by means of the feed conveyor 28. Together with the discharge conveyor 30, said transfer device 36 deflects the objects 10 through 90°, so that the latter can be conveyed onward in the conveying direction F in the overlapping formation S. The conveying speed $v_1$ of the discharge conveyor 30 is coordinated with the conveying speed $v_2$of the feed conveyor 28 in such a way that the overlap distance B in the overlapping stream S is constant. As described in connection with FIG. 1, a specific number, 6 in the present case, of the objects 10 in the overlapping stream is gripped from the side of the aligned side edge 14 by each transport clamp 18 and transported onward. In the situation shown in FIG. 2, the first output point 38 is active and the latter deflects the objects 10 released section by section by the relevant open transport clamp 18 on to the relevant belt conveyor 40, forming an overlapping formation. For completeness, it should be mentioned that, in order to permit the clean deflection and formation of an overlapping formation with a constant overlap distance as viewed in the conveying direction F, upstream of the belt conveyor 40 the latter is adjoined by a belt conveyor which conveys the objects 10 released by a transport clamp 18 and belonging to the relevant section onward in the conveying direction F to the relevant transfer device 36'.

If the desired number of objects have been fed to the relevant belt conveyor 40 at the first output point 38, as viewed in the conveying direction F, the deflection elements 32 of the transfer device 36' are moved into the rest position, and the transport clamps 18 are no longer opened as they run past the relevant output point 38, as a result of which the objects 10 are then fed to an output point 38 located downstream and transferred there to the relevant belt conveyor 40 in the same way by being deflected through 90°. The overlapping formation resting on said belt conveyor 40 is identical with the overlapping formation on the feed conveyor 28.

As specified by the arrow indicated in the conveying direction F, it is also conceivable to release the objects 10 in the overlapping stream S again and, for example, to convey them onward in the conveying direction F by means of a belt conveyor.

If objects 10 with a second extent $A_2'$ are produced by means of the rotary printing machine 26, the deflection elements 32 of the transfer device 36 are displaced in the direction opposite to the feed direction Z by the difference between the two extents $A_2$ and $A_2'$. The consequence of this is that, after the deflection of the objects 10 through 90°, the right-hand side edge 14 of all the objects 10, as viewed in the conveying direction F, is again at the same location. This ensures that the objects 10 can be picked up section by section without problems by means of the transport clamps 18. Otherwise, the apparatus functions in the same way as described further above.

However, the important factor is that, irrespective of the format in which the objects leave the rotary printing machine 26 or the storage unit, they are all transferred into an overlapping formation S in which their specific extent Al runs in the conveying direction F.

Figure 3:
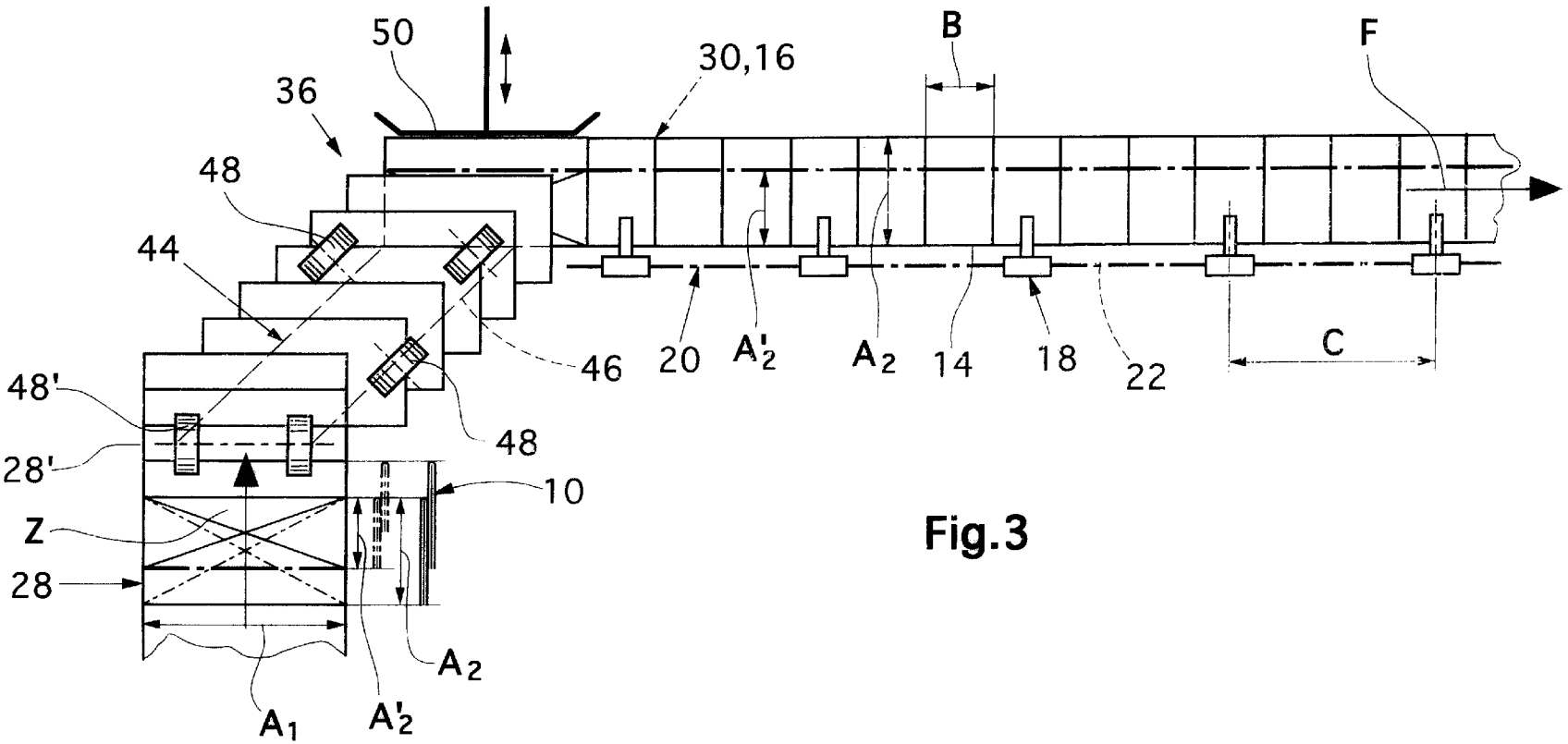
FIG. 3 shows a further embodiment of an apparatus according to FIG. 2.

The embodiment shown in FIG. 3 is very similar to that of FIG. 2, but the transfer device 36 between the feed conveyor 28 and the discharge conveyor 30 running at right angles to the latter now has an intermediate conveyor 44 arranged at an angle to both conveyors—the angle between the conveying direction Z of the feed conveyor 28 and the conveying direction of the intermediate conveyor 44 is 45°, but can also be greater or smaller. The intermediate conveyor 44 has a large number of conveying tapes 46 arranged beside one another, which interact with weighted rollers 48. Also assigned to the feed conveyor 28, which is designed as a belt conveyor, are further weighted rollers 48' at its outlet 28'. In addition, the transfer device 36 has a stop 50 assigned to the discharge conveyor 30, constructed as a belt conveyor, and adjustable on the basis of the second dimension $A_2$.

The objects 10, which arrive in an overlapping formation with a specific first extent at right angles to the feed direction Z, are appropriately deflected whilst maintaining a mutually parallel attitude at the transfer point from the feed conveyor 28 to the intermediate conveyor 44, and are transferred into a "diagonal overlapping formation". A further deflection of the objects 10, whilst maintaining their mutually parallel attitude, takes place at the transfer point from the intermediate conveyor 44 to the discharge conveyor 30, constructed as a belt conveyor. The maintenance of the mutually parallel attitude is ensured by the interaction of the weighted rollers 48, 48' with the relevant transport tapes or transport belts, by said weighted rollers in each case also being arranged at the downstream end of the relevant conveyors.

FIG. 3 shows, to the side of the feed conveyor 28 and using continuous lines, objects 10, folded newspapers, which are arranged in an overlapping formation and, as viewed in the feed direction Z, have a second extent $A_2$. Dash-dotted lines show objects 10 which have a significantly shorter second extent $A_2'$. The overlap distance between the objects 10 and their first dimension $A_1$ are always the same, however. This and the mutually coordinated speeds of all the conveyors ensure that the overlap distance B in the overlapping stream S has the desired magnitude. In addition, all the objects 10 are transferred into the overlapping formation S in such a way that their specific first extent Al runs in the conveying direction F. Here, in each case three objects 10 are gripped by each transport clamp 18 for onward transport, and each object 10 is in each case held by a single transport clamp 18.

Possible embodiments of transfer devices 36 according to FIG. 3 are disclosed, for example, in EP-A-0 310 988, EP-A-0 484 177 and WO 94/13566.

If the objects arrive with the specific first extent at right angles to their conveying direction and a different second extent as viewed in the conveying direction, they can also be rotated about an axis running transversely with respect to the surface of the objects. Apparatus suitable for this is disclosed, for example, by CH-A-546 197 and the corresponding U.S. Pat. No. 3,809,214, and the patent publication EP 0901977A1 and U.S. application Ser. No. 09/151,256.

The apparatus can be constructed particularly simply if the objects arrive in an overlapping formation with a constant overlap distance. If this is not the case, the arrangement of the objects 10 at the desired overlap distance can be achieved in a known way, for example by coordinating conveying speeds.

That which is claimed:

1. An apparatus for transporting flat, generally rectangular objects which have a specific first extent ($A_1$) and a variable second extent ($A_2$) running at right angles thereto, and comprising a conveying conveyor which is configured to convey the objects in an overlapping stream at a substantially constant overlap distance, with the first extent ($A_1$) running in the conveying direction and with one of the sides of the overlapping stream which runs in the conveying direction defining a specific lateral position composed of mutually aligned edges of the objects, a conveying device mounted adjacent the conveying conveyor and comprising a plurality of individually controllable transport clamps arranged one behind another at a fixed spacing in the conveying direction, and with the conveying conveyor and the conveying device being interconnected so as to be coordinated with each other so that each transport clamp grips a specific number which is at least two of the successive objects in the overlapping stream to transport them onward, a feed conveyor which is configured to convey the objects in an overlapping stream with the first extent ($A_1$) running at right angles to the conveying direction of the feed conveyor, and a transfer device which is positioned between the feed conveyor and the conveying conveyor for transferring objects fed by the feed conveyor into the overlapping stream on the conveying conveyor.

2. The apparatus as claimed in claim 1, wherein the transport clamps have a movement path as viewed in the conveying direction, which runs along that specific side of the conveyor on which the edges of the objects are mutually aligned, and the transport clamps are configured to grip the objects at that side.

3. The apparatus as claimed in claim 2, wherein the transport clamps are arranged one behind another on a conveying element that circulates in the conveying direction, and the fixed spacing is at least as great as the specific first dimension ($A_1$) of the objects.

4. The apparatus as claimed in claim 1, wherein the feed conveyor has an outlet which is arranged on one side of the conveying conveyor running at a right angle to the conveying direction of the feed conveyor, and the transfer device has at least one deflection element which is mounted so as to circulate at a distance from the outlet of the feed conveyor above the conveying conveyor and with the conveying conveyor forms a conveying gap which tapers in the conveying direction of the feed conveyor and acts in the same direction as the conveying direction of the conveying conveyor.

5. The apparatus as claimed in claim 1, wherein the transfer device between the feed conveyor and the conveying conveyor running at right angles to the conveying direction of the feed conveyor includes an intermediate conveyor which runs at an angle to the conveying directions of the feed conveyor and the conveying conveyor, so that the objects maintain a mutually parallel attitude.

* * * * *